United States Patent [19]

Schaefer

[11] Patent Number: 4,818,183

[45] Date of Patent: Apr. 4, 1989

[54] LOW IMPEDANCE FAN SAFETY GUARD

[76] Inventor: Ronald E. Schaefer, 5818 Michael Ct., St. Cloud, Minn. 56301

[21] Appl. No.: 128,163

[22] Filed: Dec. 3, 1987

[51] Int. Cl.[4] ..... F04D 29/70

[52] U.S. Cl. ..... 416/247 R

[58] Field of Search ..... 416/247 R; 415/121 G

[56] References Cited

U.S. PATENT DOCUMENTS

| | | | |
|---|---|---|---|
| D. 153,452 | 4/1949 | Owens et al. | 416/247 R X |
| 2,017,431 | 10/1935 | Anderson et al. | 416/247 R X |
| 2,259,853 | 10/1941 | Koch | 416/247 R X |
| 2,617,583 | 11/1952 | Kemler | 416/247 R X |
| 2,624,504 | 1/1953 | Viewwegh | 416/247 R X |
| 2,656,974 | 10/1953 | Holstein | 416/247 R X |
| 2,728,519 | 12/1955 | McLarty | 416/247 R X |
| 2,829,819 | 4/1958 | Corwin | 416/247 R X |
| 2,862,652 | 12/1958 | Copeland et al. | 416/247 R X |
| 3,347,452 | 10/1967 | Radcliffe | 416/247 R |
| 3,787,142 | 1/1974 | Dupke | 416/247 R X |
| 3,791,333 | 2/1974 | Losch | 416/247 R X |
| 3,963,382 | 6/1976 | Patton | 415/121 G |
| 4,022,548 | 5/1977 | McLarty | 416/247 R |

*Primary Examiner*—Robert E. Garrett
*Assistant Examiner*—Joseph M. Pitko
*Attorney, Agent, or Firm*—Palmatier & Sjoquist

[57] ABSTRACT

A low impedance safety guard for an air circulating fan with rotating fan blades which prevents a human hand, finger or foot from getting into the path of the rotating blades while yet achieving the unrestrictive air stream benefits of a relatively open guard which is generally considered unsafe. The guard comprises rear and front parallel and opposing substantially open, air stream unobstructive fan blade guard faces which will permit the hand, finger or foot to pass partially therethrough. A substantially closed circumferential wall is provided which connects the rear and front faces to enclose the fan blades approximately equal distant from the respective faces to prohibit the hand, figure or foot from reaching the blade path after passing partially through either face should a person unfortunately attempt to do so.

8 Claims, 3 Drawing Sheets

PRIOR ART

LOW IMPEDANCE FAN SAFETY GUARD

BACKGROUND OF THE INVENTION

This invention relates to a low impedance safety guard for an air circulating fan with rotating fan blades.

It is well known that air circulating fans generally include an electrical fan motor having a protruding rotatable shaft for fixing a blade impeller thereon. The impeller typically includes several fan blades which draw air from the rear and impel it forwardly in a direction forward of the fan.

Many known older patented fan guards, cages, or shrouds characteristically are very open which effectively do not obstruct or impede the impelled air stream which is the objective of the air circulating fan, as shown in FIG. 1. However, guards of this style do not effectively prohibit objects from coming into contact with the rotating fan blades, such as human hands, fingers or toes. The following U.S. patents are illustrative of this open type of guard: U.S. Pat. Nos. 4,022,548; 3,347,452; 2,862,657; 2,728,519; 2,624,504; 2,617,583; 2,829,819; 2,259,853 and 2,017,431.

Because of the numbers of severed human appendages and other related types of injuries from the above identified style of fan safety guards, the Occupational Safety and Health Administration (OSHA) has required that fan shrouds or guards be more closed in their general overall structure, as shown in FIG. 2, to prevent hands, fingers and toes from getting into the path of the rotating blades. Fan safety guards which typically represent this closed style may be represented by the following U.S. Pat. Nos.: 4,657,485; 4,222,318; 3,963,382; 3,791,333; 3,787,142; and 3,262,638.

Problematically, the OSHA approved style of fan guard, although safe, unduly impedes, obstructs or baffles the air stream which defeats the objective of circulating the air by the use of a fan. Also, dust and dirt more readily collects on the highly restrictive style of guards.

SUMMARY OF THE INVENTION

Figure 3:
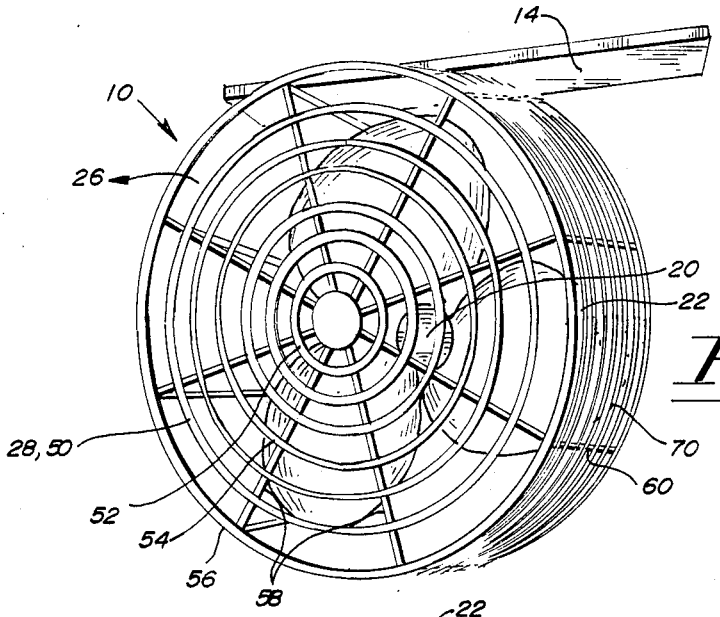
FIG. 3 is a front perspective view of the invention.
Figure 4:
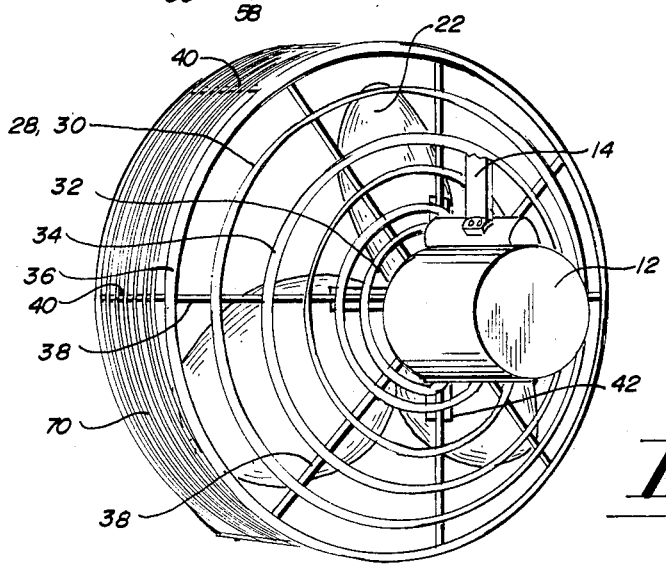
FIG. 4 is a rear perspective view of the invention.
Figure 2:
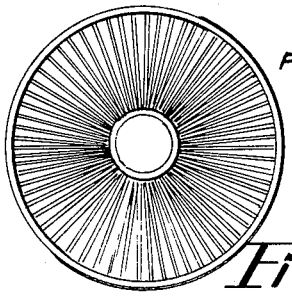
Fig. 2. PRIOR ART
FIG. 2 is a front elevational view of a prior art restrictive or closed guard.
Figure 1:
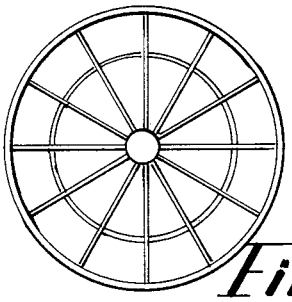
FIG. 1 is a front elevational view of a prior art open guard.
Figure 5:
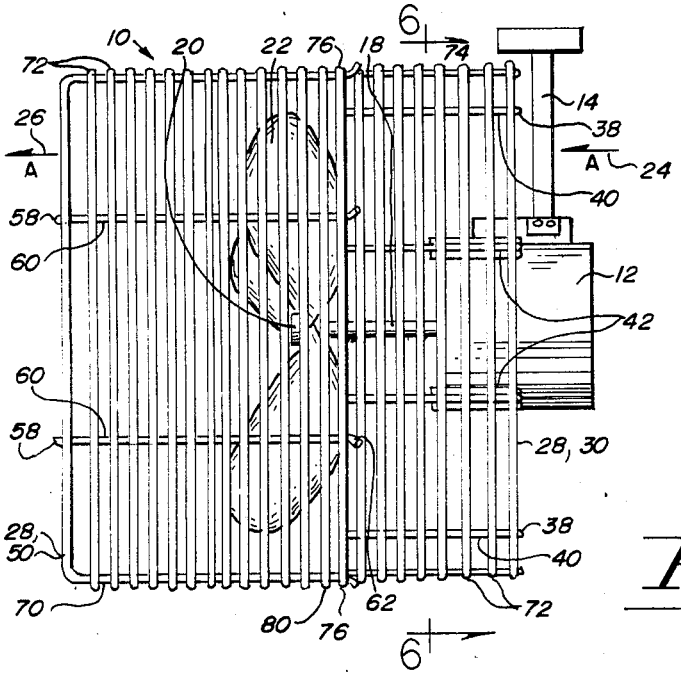
FIG. 5 is a side elevational view of the invention.

A low impedance safety guard for an air circulating fan with rotating fan blades which prevents a human hand, finger or foot from getting into the path of the rotating blades while yet achieving the unrestrictive air stream benefits of a relatively open guard which is generally considered unsafe. The guard comprises rear and front parallel and opposing substantially open, air stream unobstructive fan blade guard faces which will permit the hand, finger or foot to pass partially therethrough. A substantially closed circumferential wall is provided which connects the rear and front faces to enclose the fan blades approximately equal distant from the respective faces to prohibit the hand, figure or foot from reaching the blade path after passing partially through either face should a person unfortunately attempt to do so.

The principal object of this invention is to overcome the above noted disadvantages by providing a safety guard for fans of the open type which will still prevent anyone, including children, from getting their hands, fingers or feet into the path of the rotating fan blades, while at the same time not obstructing the air stream from the fan.

Other objects and advantages will become apparent as more fully pointed in detail within the specification.

DETAILED SPECIFICATION OF THE INVENTION

Referring to FIGS. 3-7, the invention comprised of a low impedance fan safety guard may be clearly seen.

Air circulating fans generally include fan motor 12 with some type of support or hanger 14 with mounting bolts 16 located on the motor housing. A rotating shaft 18 extends from the motor 12 whereon blade impeller 20 is mounted having fan blades 22. Air is typically drawn towards the fan from the rear (see arrow 24, FIG. 5) and impelled forwardly in the direction of the front face of the fan (see arrow 26, FIG. 5).

The fan safety guard 10 of the invention generally includes two parallel substantially open fan blade guard faces or ends 28 comprised of a rear group of concentric wire rings 30 fixedly held in place by radially extending rear wire ribs 38. A front group of concentric wire rings 50 are similarly held fixedly in place by radially extending front wire ribs 58. A cylindrical or circumferential connecting wall 70 connects the rear 30 and front 50 groups of concentric wire rings thereby enclosing the rotating fan blades 22.

The rear group or face of concentric wire rings 30 may be made of wire approximately 0.135 inches in diameter. The small central ring or hoop 32, intermediate rings 34 and large peripheral ring 36 are approximately $\frac{7}{8}''$ to 1" apart which will permit characterizing the rear group 30 as being a substantially open face which will permit fingers to pass therethrough but will not permit the palm of the hand to pass between any of rings 32, 34 and 36.

Radially extending rear wire ribs 38 effectively crisscross rings 32, 34 and 36 and may be affixed thereto by spot or butt welding to fixedly hold the rear group of wire rings 30 in planar alignment. Ribs 38 each suitably have a dog legged or right angled portion 40 which extends inwardly of the guard for rigidly supporting the circumferential connecting wall 70, as discussed hereinafter. Motor mounting brackets 42 may similarly be affixed to the rear group of concentric wire rings 30, adjacent ribs 38, for effectively mounting the guard 10 to the fan motor bolts 16.

The front group or face of concentric wire rings 50 generally includes a small central ring or hoop 52 with intermediate rings 54 and a large peripheral ring 56. Rings 52, 54 and 56 are rigidly held in alignment by the spot welding of radially extending front wire ribs 58 to rings 52, 54 and 56. Ribs 58 similarly include a dog-legged or right-angled portion 60 which extends inwardly of the guard 10. The right-angled extending portions 60 of ribs 58 have outwardly turned ends 62 adjacent outermost ring 80 which is somewhat resilient for the releaseable interconnection of rear face 30 and front face 50 with circumferential connecting wall 70, as discussed in more detail below.

Cylindrical or circumferential connecting wall 70 permits the connection of rear face 30 and front face 50 and is characterized as a substantially closed wall which will not permit the passage of fingers or toes therethrough by the close arrangement of equal diameter, parallel coaxial rings 72.

More particularly, circumferential wall 70 is comprised of a rear portion 74 fixedly held by the right-angled portions 40 of ribs 38 while an outermost ring 76 permits the interlocking of resilient outwardly turned ends 62 of front ribs 58, which extend from front portion 78 of circumferential wall 70, with outermost ring 76 of rear protion 74 of circumferential wall 70.

Figure 7:
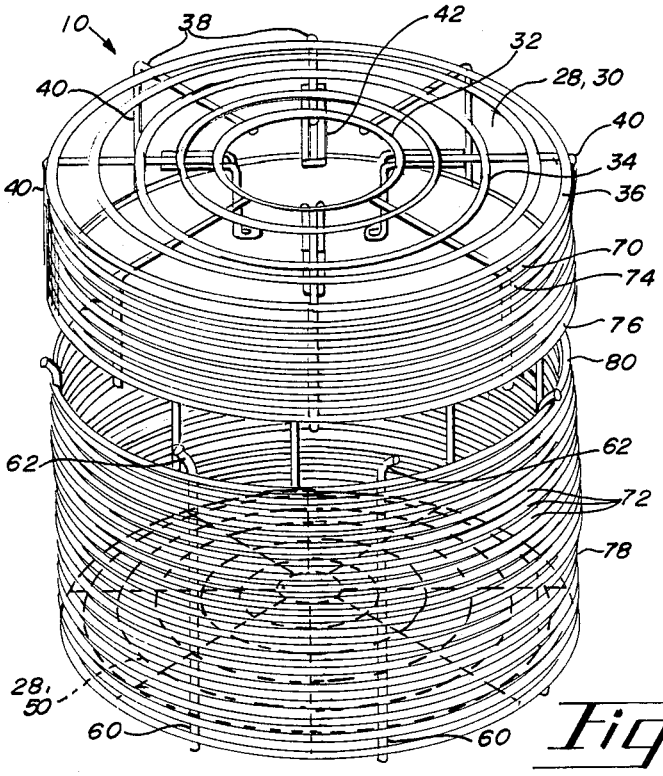
FIG. 7 is an exploded side elevational view of the invention.
Figure 6:
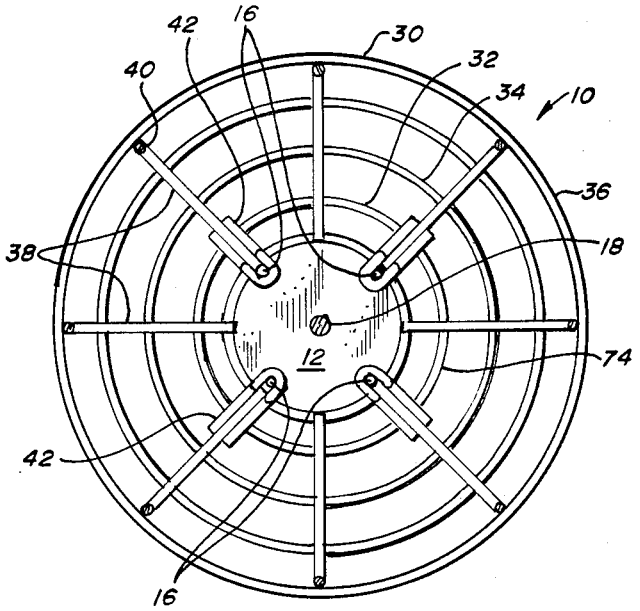
FIG. 6 is a cross-sectional along lines 6-6 of FIG. 5.

The low impedance fan safety guard 10 of the invention can also generally be characterized as a comprising rear face 30 interconnected with the rear portion 74 of circumferential wall 70 and a front face 50 interconnected with front portion 78 of circumferential wall 70—two cylindrically-shaped guard halves that are interlockable as shown in FIG. 7.

In operation, the individual mounts motor mounting bracket 42 of guard 10 to motor bolts 16. Thereafter, the outwardly turned end 62 of front ribs 58 are flexed inwardly to permit their bypass and interlocking action with the outermost ring 76 of rear portion 74 of circumferential wall 70.

With safety guard 10 assembled, the air circulating fan may be safely operated. Neither fingers nor toes may pass between the equal diameter, parallel coaxial rings 72 of the circumferential wall 70. Because the rear group or face 30 of concentric wire rings 32, 34 and 36 and the front face 50 group of concentric wire rings 52, 54 and 56 are spaced such a distance from the path of the rotating fan blades 22, an individual may not reach the rotating blades 22. The fan thus operates safely without unduly impeding, obstructing or baffling the air stream which is generated by fan motor 12.

The present invention may be embodied in other specific forms without departing from the spirit or essential attributes thereof. Therefore, the illustrated embodiment should be considered in all respects as illustrative and not restrictive, reference being made to the appended claims rather than to the foregoing description to indicate the scope of the invention.

What is claimed is:

1. A low impedance safety guard for an air circulating fan with rotating fan blades which prevents a human hand, finger or foot from getting into the path of the rotating fan blades while yet achieving the unrestrictive air stream benefits of a relatively open guard which is generally considered unsafe, comprising:

(a) rear and front parallel and opposing substantially open, air stream unobstructive fan blade guard faces in front and behind the fan blades, respectively, which will permit the hand, finger or foot to pass partially therethrough;

(b) a substantially closed circumferential wall located about the rotatable fan blades; and (c) means for connecting the faces and circumferential wall together to enclose the fan blades approximately equal distant from the respective faces to prohibit the hand, finger or foot from reaching the blade path after passing partially through either face.

2. The safety guard of claim 1 wherein the means is releasable.

3. The safety guard of claim 1 wherein the connecting means comprises at least three radially extending ribs fixed on to either of the faces each having a substantially right-angled portion with an end wherein the angled portion is directed inwardly of the guard and the end being adapted to catch onto the adjacent circumferential wall for connecting the faces with the circumferential wall.

4. The safety guard of claim 1 wherein the front and rear faces each comprise a group of concentric wire rings spaced apart from one another as to not unduly interfere with the airstream while yet prohibiting the human hand, finger or foot to pass between and substantially beyond the rings to the vicinity of the fan blade path.

5. The safety guard of claim 4, further comprising at least three radially extending ribs for each face fixed onto the rings of each face for fixedly holding the rings in alignment.

6. The safety guard of claim 5 wherein the connecting means comprises a substantially right-angled portion of each rib directed inwardly of the guard having an end, the end and the circumferential wall being adapted to interlock the rear and front faces with the circumferential wall.

7. The safety guard of claim 1 wherein the substantially closed circumferential connecting wall comprises substantially parallel and equal diameter coaxial rings which are sufficiently close together to prohibit the human hand, finger or foot to pass between the rings.

8. A low impedance safety guard for an air circulating fan with a rotating blade which prevents a hand, finger or foot from getting into the path of the rotating blades while yet achieves the unrestricted air stream benefits of a relatively open guard which is generally considered unsafe, comprising:

(a) two cylindrically-shaped guard halves each comprising:

one open end;

(ii) a substantially closed circumferential wall portion; and (iii) a substantially open, air stream unobstructive fan blade guard face opposing the open end which will permit the hand, finger or foot to pass partially therethrough; and (b) interconnecting means for connecting the adjacent open ends of the guard halves together to enclose the fan blades approximately equal distance from the respective faces to prohibit the hand, finger or foot from reaching the blade path after passing partially therethrough.

* * * * *